United States Patent [19]

Addie et al.

[11] 4,432,182

[45] Feb. 21, 1984

[54] CEILING TILE SUSPENSION SYSTEM

[75] Inventors: Lee W. Addie; James C. Ollinger, both of Lancaster, Pa.

[73] Assignee: Armstrong World Industries, Inc., Lancaster, Pa.

[21] Appl. No.: 302,981

[22] Filed: Sep. 17, 1981

[51] Int. Cl.[3] ..... E04B 5/52; E06B 3/54

[52] U.S. Cl. ..... 52/480; 52/483; 52/489; 52/509; 52/765

[58] Field of Search ..... 52/489, 509, 483, 511, 52/484, 512, 765, 779, 774, 359, 360, 346, 364, 127.1

[56] References Cited

U.S. PATENT DOCUMENTS

| | | | |
|---|---|---|---|
| 717,923 | 1/1903 | Rapp | 52/368 |
| 1,997,581 | 7/1932 | Heeren et al. | 52/489 |
| 2,278,822 | 4/1942 | Benz | 52/480 |
| 2,447,694 | 8/1948 | Finch | 52/489 |
| 2,469,252 | 5/1949 | Wiegert et al. | 52/589 |
| 2,653,686 | 9/1953 | Routt | 52/489 |
| 2,841,255 | 7/1958 | Kemp | 52/489 |
| 3,232,018 | 2/1966 | MacKean | 52/489 |
| 3,412,515 | 11/1968 | Finon | 52/489 |

FOREIGN PATENT DOCUMENTS

| | | | |
|---|---|---|---|
| 2031986 | 4/1980 | United Kingdom | 52/489 |

*Primary Examiner*—Alfred C. Perham
*Assistant Examiner*—Mark J. Sofia

[57] ABSTRACT

The ceiling tile suspension system is composed of a runner structure and a clip structure. The runner structure is generally trapezoidal in cross section with two flanges spaced away from a ceiling structure. The clip structure includes a flat base portion with flanges that grasp the flanges of the runner. The clip structure has a serrated edge connected to the flat base portion and the serrated edge either digs into the edge of the ceiling tile or slips into a kerf in the edge of the ceiling tile to hold the ceiling tile in position against the clip flat base portion.

1 Claim, 3 Drawing Figures

FIG. 1
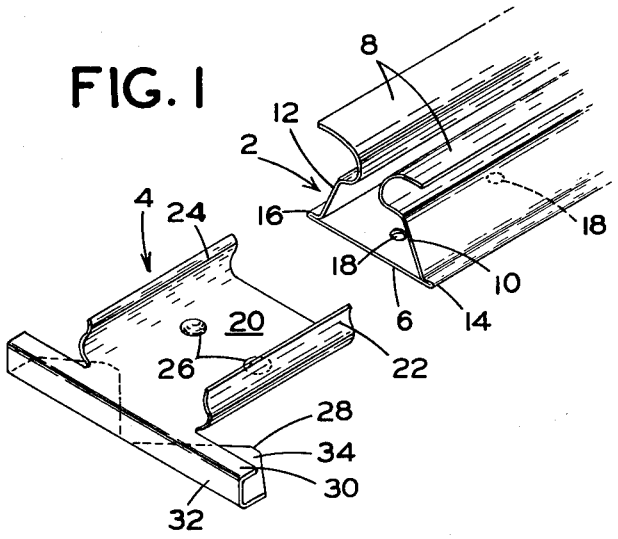
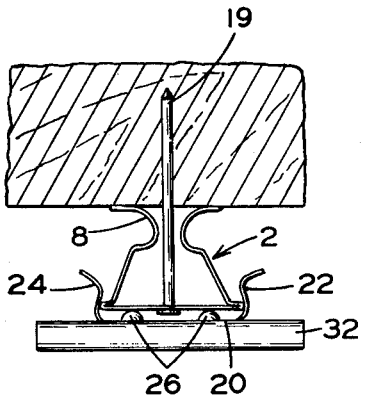
FIG. 2
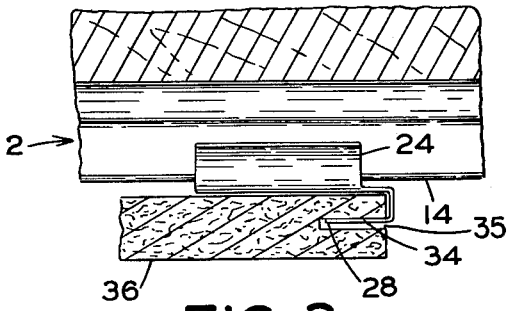
FIG. 3

CEILING TILE SUSPENSION SYSTEM

BACKGROUND OF THE INVENTION

1. Field of the Invention

The invention is directed to a ceiling tile suspension system and, more particularly, to a two-part suspension system composed of a runner and a clip.

2. Description of the Prior Art

U.S. Pat. No. 2,469,252 discloses a means for mounting wall and ceiling panels. In FIG. 4, of that patent, a metal furring strip is shown having a central groove 16 and an outwardly extending flange 17 upon which are mounted clips having barbs or teeth 13. These barbs or teeth are spaced above flat base portions 14 which are provided with underturned flanges 15 to engage the flanges 17.

U.S. Pat. No. 717,923 discloses a studding structure for use in forming partitions such as walls and ceilings. This structure is made from sheet metal and is provided with edges a2 which clamp and hold a fastening device for the studding.

SUMMARY OF THE INVENTION

The invention is directed to a ceiling tile suspension system which is formed from two parts. The first part is a runner structure which has a generally trapezoidal shape. A flat base forms the large side of the trapezoid and the two legs form the inclined sides of the trapezoid. The flat base has flanges on the edges thereof and apertures in the center therethrough. The legs are resiliently mounted and their ends extend toward each other. A nail passed through an aperture in the flat base will be gripped by the ends of the resilient legs.

The second part of the suspension system is a clip structure which is releasably fastened and slidably mounted along the runner. The clip has a body portion and on two opposite sides thereof, spring legs or flanges extend from the body portion. These spring legs will releasably grasp the flanges of the runner member. Indents are provided on the body member so that the body member is spaced from the flat base of the runner structure and minimal frictional contact is maintained between the two structures. On a third side of the clip member, there is provided a C-shaped structure which is provided on its one edge with a serrated edge. This serrated edge is parallel to the plane of the body member and spaced therefrom. The serrated edge engages a ceiling tile to hold the ceiling tile in position adjacent the flat base of the runner structure.

BRIEF DESCRIPTION OF THE DRAWING

FIG. 1 is a perspective view of the runner structure and the clip structure in a disassembled state;

FIG. 2 is an end view of the runner structure and clip structure in an assembled state; and FIG. 3 is a side view of FIG. 2 showing the clip member engaging a ceiling tile.

DESCRIPTION OF THE PREFERRED EMBODIMENT

The ceiling tile suspension herein is composed of two parts which are shown in FIG. 1. The first part is a runner structure 2 and the second part is a clip structure 4. The runner structure 2 is generally of trapezoidal cross section having the flat base 6 being one side of the trapezoid with the lips 8 forming the other parallel side of the trapezoid, and the legs 10 and 12 forming the inclined sides of the trapezoid. The flat base 6 is provided with flanges 14 and 16, and these flanges extend in a parallel relationship, extend beyond the point where the end of the legs 10 and 12 are adjacent the flat base, and are spaced from the ceiling structure to which the runner is fastened. The flat base is provided with a plurality of holes or apertures 18 spaced therealong at intervals of about 1 inch apart, midway down the flat base between the two parallel flanges. The legs 10 and 12 are resiliently mounted to the flat base 6 and are formed with two lip structures 8 on the ends of the legs 10 and 12 opposite from where the legs are connected to the flat base 6. The lips are actually formed by shaping the ends of the legs into a C-shape with the two C shapes facing away from each other to form the structure shown in FIG. 1. The two lips do not engage and are spaced apart from each other a distance ranging from slightly less than to the same as the diameter of the apertures 18. As best shown in FIG. 2, a nail 19 is placed through an aperture 18 and is resiliently held in the aperture 18 by the body of the nail being grasped between the two lips 8. Consequently, the runner is particularly easy to mount in position because one may hold the runner up against a ceiling structure, insert a nail through the aperture 18, and have the nail retained in the aperture by the lips 8 so that the other hand of the user of the suspension system may use a hammer to drive the nail in place. Consequently, one hand is driving the nail while the other hand is holding the runner in place and there is no need for a "third hand" to attempt to hold the nail while it is being driven.

The second part of the suspension system is the clip structure 4. The clip has a flat body portion 20 and this flat body portion is meant to overlay the flat base 6 of the runner member. On two opposite sides of the flat body there are provided flanges 22 and 24 which extend substantially perpendicular to the plane of the flat body 20. The flanges are generally of an S configuration and are formed as clip fasteners. The flanges 22 and 24 are spaced apart and so positioned that they will slide over the flanges 14 and 16 of the runner structure and be spread apart and then snap around the flanges 14 and 16 so that the flat body 20 of the clip is held adjacent the flat base 6 of the runner. The flat body 20 of the clip is provided with 2 indentations 26 which project outward on the side of the flat body portion having the two flanges 22 and 24 projecting perpendicularly therefrom. Thus, the flat body 20 does not directly engage the flat base 6 but is spaced from flat base 6 due to the two indentations. The two indentations minimize the contact between the clip 4 and the runner 2 to contact along the two flanges 22 and 24 and the indentations 26. Consequently, the clip can be readily slid along the runner structure to put the clip in whatever position one desires to locate it. On a third edge of the flat body 20 between the two edges containing the flanges 22 and 24 there is positioned a C-shaped element. This element extends to the opposite side of the flat body 20 having the flanges 22 and 24. The C shape is basically composed of two parallel members, 30 and 34, and one perpendicular vertical member 32 in generally the form of a C. One of the parallel members 30 is positioned in the plane of the flat body 20. The perpendicular vertical member 32 extends from that member 30 in a direction away from the direction the flanges 22 and 24 extend from the flat body 20. The second parallel member 34 of the C-shaped element is spaced from the flat body 20 and is in a plane generally parallel thereto. The edge of this member 34 is provided with a serrated edge 28.

As shown in FIG. 2, a nail passes through the flat base of runner 2 and between the lips 8 and then into an overlying ceiling structure to mount the runner 2 in position. The flanges 22 and 24 of the clip engage the flanges 14 and 16 on the runner. The protrusions 26 space the flat base 6 of the runner from the flat body 20 of the clip. The C-shaped structure is then shown in part as element 32 and it is positioned below the flat body 20 of the clip. FIG. 3 is a side view of FIG. 2 and there is shown therein the flange member 24 on the flange 14 of the runner 2. The C-shaped element with its serrated edge 28 is engaged in the kerf 35 of a ceiling board 36. Should the ceiling board not have an appropriate kerf or indentation in the edge thereof, the serrated edge of the clip could be readily pushed into the edge of the ceiling board is held in position by the clip with the back of the ceiling board being held up against the flat base 6 of the clip and the clip in turn is held against the runner which in turn is nailed to the overlying ceiling.

What is claimed is:

1. A ceiling suspension system comprising (a) a runner structure having:

(1) a generally trapezoidal cross section with a flat base having a plurality of holes of a certain diameter therein and two parallel edges forming flanges;

(2) inwardly of the flanges and fastened to the flat base there are two leg members resiliently mounted and inclined slightly toward each other and each having a lip structure;

(3) the lips of the two legs being spaced apart a distance ranging from slightly less than to the same as the diameter of the holes through the flat base of the runner;

(b) a clip structure comprising:

(1) a flat body having on two opposite sides thereof flange means projecting from the flat base generaly perpendicular therefrom and being of and S-shaped configuration, the spacing between said flange means being such that said flange means will spring away from the edge of the flanges of the runner structure and then spring around the edge of the flange of the runner structure to hold the flat body of the clip adjacent the flat base of the runner;

(2) a C-shaped projection fastened to a third side of the clip flat body, said C-shaped projection having two parallel sides and one perpendicular connecting side with one parallel side being positioned in the plane of the flat body, said perpendicular side extending from the plane of the flat body in a direction opposite from the direction that the flange means extend from the flat body, and the second parallel side of the C-shaped projection being in a plane parallel to the flat body and spaced therefrom;

(c) a ceiling tile positioned adjacent the flat body of the clip and the edge of said ceiling tile being engaged by the side of the C-shaped projection in the plane spaced from, and parallel to, the flat body of the clip; and (d) a fastening means passing through a hole of the flat base of the runner and between the lips of the legs of the runner into an overlying ceiling structure to mount the runner adjacent a ceiling structure with the clip being mounted on the runner and a ceiling tile being retained by said clip.

* * * * *